United States Patent [19]

Yamashita et al.

[11] Patent Number: 4,609,347

[45] Date of Patent: Sep. 2, 1986

[54] SKID BUTTON STRUCTURE

[75] Inventors: Hajime Yamashita; Toshiyuki Hirao; Masatoshi Yamazaki, all of Kariya, Japan

[73] Assignee: Toshiba Ceramics Co., Ltd., Tokyo, Japan

[21] Appl. No.: 722,453

[22] Filed: Apr. 12, 1985

[30] Foreign Application Priority Data

Sep. 8, 1984 [JP] Japan ..... 59-166947

[51] Int. Cl.[4] ..... F27D 3/02; F27B 9/14

[52] U.S. Cl. ..... 432/234; 432/122

[58] Field of Search ..... 432/122, 234

[56] References Cited

U.S. PATENT DOCUMENTS

| | | | |
|---|---|---|---|
| 3,411,762 | 11/1968 | Evans | 432/122 |
| 4,293,299 | 10/1981 | Gaddes | 432/234 |
| 4,470,808 | 9/1984 | Knaak et al. | 432/234 |

FOREIGN PATENT DOCUMENTS

| | | | |
|---|---|---|---|
| 54-102205 | 8/1979 | Japan . | |
| 56-52266 | 12/1981 | Japan . | |
| 57-123916 | 8/1982 | Japan . | |
| 57-40297 | 9/1982 | Japan . | |
| 58-35640 | 8/1983 | Japan . | |
| 929982 | 5/1982 | U.S.S.R. | 432/234 |

*Primary Examiner*—John J. Camby

*Attorney, Agent, or Firm*—Pahl, Lorusso & Loud

[57] ABSTRACT

A walking beam type heating furnace for steels has a conventional skid pipe through which a coolant flows, a skid button made of a ceramic material, a base fixed to an upper portion of the skid pipe, an attachment frame attached to the base for holding the skid button in its supporting position, and a thermal insulating material placed at a bottom portion of the skid button for supporting the skid button. The thermal insulating material has a high strength, high density, low thermal conductivity and high coefficient of thermal expansion such as quartz glass, vycol glass, hard glass and soda lime glass.

15 Claims, 5 Drawing Figures

SKID BUTTON STRUCTURE

BACKGROUND OF THE INVENTION

This invention relates to an improved skid button structure for a walking beam type heating furnace.

Various skid button structures for a walking beam type heating furnace have been proposed.

For example, the Japanese Utility Model publication No. 58-35640 discloses a skid button structure in which a refractory material or refractory brick is disposed between a metal base fixed to a skid pipe and a ceramic skid button. In such conventional skid button structures, because a ceramic skid button receives impacts or shocks in use one million times or more per year, the refractory brick placed at a bottom portion of the ceramic skid button is often broken and crushed and thereby reduced in size. As a result, the ceramic skid button is apt to lose its stability whereby the ceramic skid button becomes canted and finally breaks.

We have found in our experience that even if a refractory brick has a compression strength of 1.5–2 ton/cm$^2$, it is likely to be broken and crushed.

OBJECTS OF THE INVENTION

An object of this invention is to provide an improved skid button structure for a walking beam type heating furnace in which a ceramic skid button can be properly used for a long period in its best condition.

A further object of this invention is to provide a skid button structure for a walking beam type heating furnace in which a ceramic skid button can be easily attached to a skid pipe.

DETAILED DESCRIPTION OF THE PREFERRED EMBODIMENTS

Figure 1:
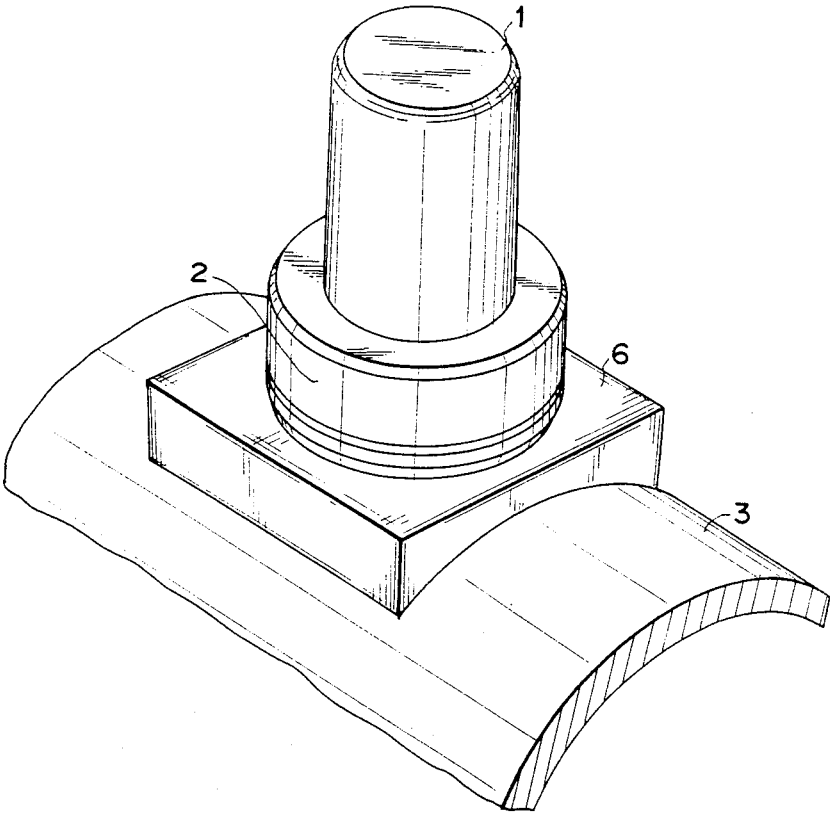
FIG. 1 is a perspective view showing a skid button structure for a walking beam type heating furnace according to a first embodiment of this invention.
Figure 2:
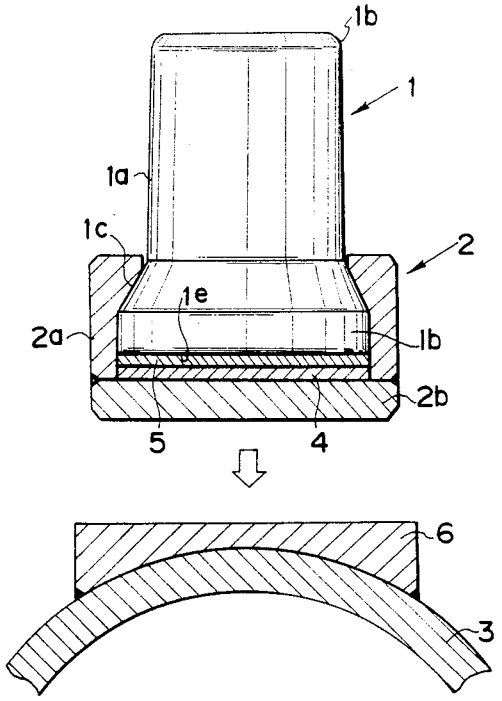
FIG. 2 is a sectional view of the skid button structure shown in FIG. 1 in its disassembled condition.

Referring now to FIGS. 1 and 2, a skid button 1 made of a ceramic material is attached to a skid pipe 3 in a walking beam type heating furnace for steel by means of a metal attachment frame 2. A coolant flows through the skid pipe 3 in a conventional manner. A heat insulating material 4 is provided at a bottom portion 1*e* of the skid button 1. A ceramic plate 5 is disposed between the heat insulating material 4 and the bottom portion 1*e* of the skid button 1.

The thermal insulating material 4 has high strength, high density, low thermal conductivity and a high coefficient of thermal expansion. Preferred examples of the thermal insulating material 4 are quartz glass, VYCOR glass, hard glass and soda lime glass. These glasses are of a non-crystalline material, which have lower thermal conductivity than crystalline materials. See Table 1 showing each thermal conductivity of various high-strength materials.

If the thermal or heat insulating material 4 is made of non-crystalline material in a plate shape, the thickness of the thermal insulating material 4 can be thin. This allows an operator to easily replace the thermal insulating material if desired.

The compression strength of the thermal insulating material is preferably 1500–2000 times the design static pressure 10–16 Kgf/cm$^2$, or more.

As the furnace temperature ranges from 100° C. to 800° C., a gap is apt to be formed between the attachment frame 2 and the ceramic button 1 due to the different coefficients of thermal expansion thereof. Therefore, the thermal insulating material 4 preferably has a high coefficient of thermal expansion in order to absorb or avoid such a gap in use.

If the thermal insulating material 4 has a high density and particularly no small hole therein, the resistance to impact increases to such a degree that the thermal insulating material 4 will not break or crumble.

The ceramic plate 5 may be made of any conventional ceramic material such as alumina porcelain. The ceramic plate 5 is used only for the purpose of compensating for the thickness of the thermal insulating material 4. Therefore, the ceramic plate 5 can be omitted if the thermal insulating material 4 has a sufficient thickness.

The skid button 1 has an upper small-diameter cylindrical portion 1*a*, a lower large-diameter cylindrical portion 1*b* and a tapered intermediate portion 1*c* therebetween. The top surface of the upper small-diameter cylindrical portion 1*a* is substantially circular and used to support steel thereon. A corner edge portion of the upper small-diameter cylindrical portion 1*a* is curved for the purpose of smoothly guiding the steel. The taper angle of the intermediate portion 1*c* is preferably 15–35 degrees. It is preferable that the lower large-diameter cylindrical portion 1*b* have a height of about 5–15. The taper shape of the intermediate portion 1*c* functions to prevent the skid button 1 from losing its stability with respect to the attachment frame 2.

The attachment frame 2 can be formed in any shape, but it preferably has a tapered internal surface corresponding to the taper shape of the intermediate portion 1*c*. In the embodiment of FIGS. 1 and 2, the attachment frame 2 consists of an upper ring portion 2*a* and a lower plate portion 2*b* fixed thereto by welding. The upper ring portion 2*a* is made of a heat resisting steel and the lower plate portion 2*b* is made of a common steel.

A base 6 is fixed onto an upper portion of the skid pipe 3. The attachment frame 2 is fixed onto the base 6 in such a way that the skid button 1 is erect. The top surface of the skid button 1 is maintained in a horizontal position.

Figure 3:
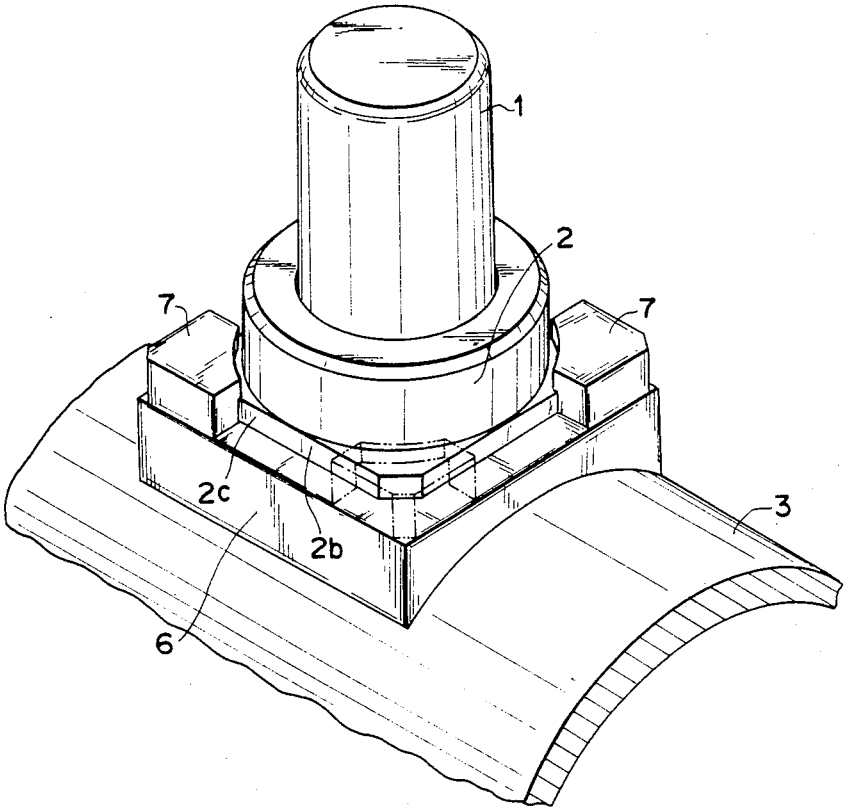
FIG. 3 is a perspective view showing a skid button structure according to a second embodiment of this invention.

FIG. 3 shows a second embodiment of this invention which is similar to the first embodiment of FIGS. 1 and 2 except for the shape of the attachment frame 2. The lower plate portion 2*b* has four corner extensions 2*c*. These extensions 2*c* are supported by four members 7 fixed to the base 6. The attachment frame 2 is removable.

The skid button 1, the thermal insulating material 4, the ceramic plate 5 and the inside configuration of the attachment frame 2 are substantially the same as that of the first embodiment of FIG. 2. Therefore, they will not be described in detail.

Figure 4:
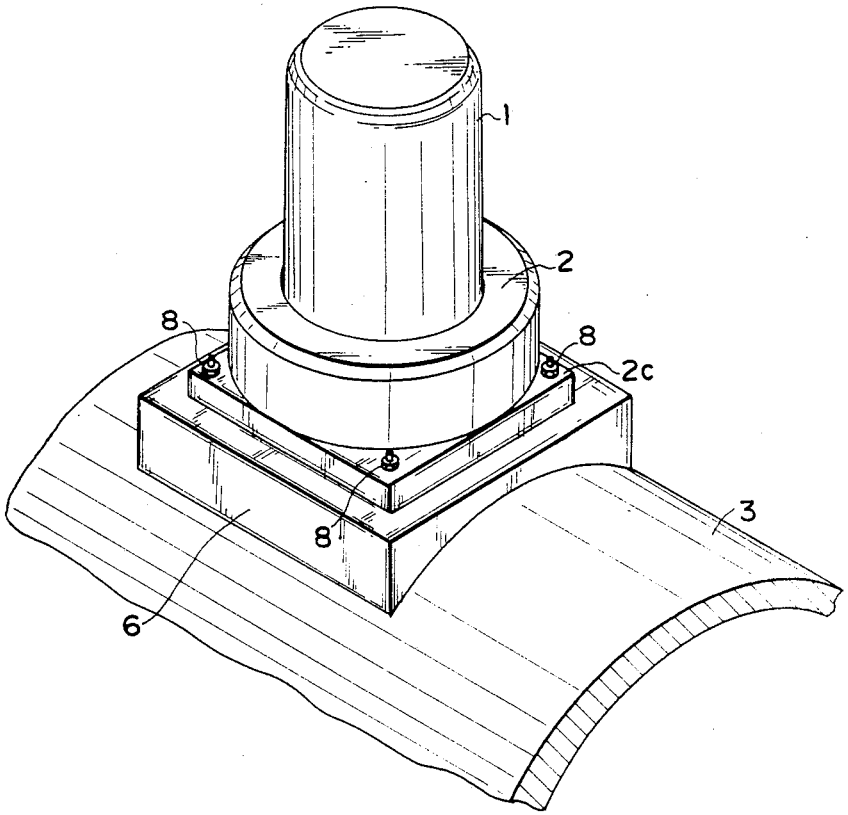
FIG. 4 is a perspective view showing a skid button structure according to a third embodiment of this invention.

FIG. 4 shows a third embodiment of this invention which is also similar to the first embodiment of FIGS. 1 and 2 except for the outer configuration of the attachment frame 2. The lower plate portion 2b of the attachment frame 2 has four corner extensions 2c each having a through hole accomodating a bolt 8 which fixes the base 6 to the attachment frame 2.

In the three embodiments described above, the skid button 1, the attachment frame 2, the thermal insulating material 4 and the ceramic plate 5 are assembled as one unit as best shown in FIG. 2 so that they can be easily attached and detached.

Figure 5:
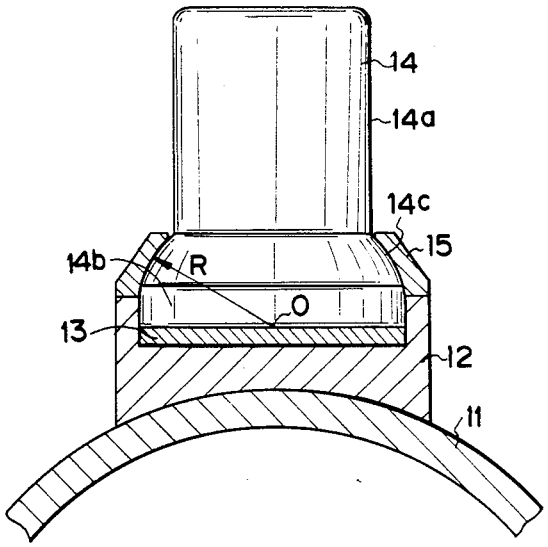
FIG. 5 is a sectional view showing a skid button structure according to a fourth embodiment of this invention.

FIG. 5 shows a fourth embodiment of this invention. A steel base 12 is fixed onto an upper portion of a skid pipe 11 in a walking beam type heating furnace for steel. A coolant flows through the skid pipe 11 in a conventional manner. A ceramic skid button 14 is fixed to the base 12 by means of an attachment frame 15.

The skid button 14 has an upper small-diameter cylindrical portion 14a, a lower large-diameter cylindrical portion 14b and an intermediate portion 14c therebetween. The intermediate portion 14c is formed in a convex male-taper shape. In other words, the intermediate portion 14c has a band-shaped portion of a spherical surface having a radius R around the center O. The attachment frame 15 has a concave female-taper surface that mates with the convex surface of the intermediate portion 14c.

A thermal insulating material 13 is placed as a spacer below the skid button 14. The thermal insulating material 13 is preferably the same as the heat insulating material 4 of the first embodiment.

Because of the special shape of the intermediate portion 14c of the skid button 14, the skid button has an excellent stability in use. For instance, even if the skid button 14 is slightly inclined, the attachment frame 15 will still hold the skid button 14 because the convex portion of the intermediate portion 14c keeps constant contact with the concave portion of the attachment frame 15.

In the embodiment of FIG. 5, the attachment frame 15 is of a ring shape and is fixed to the base 12 by welding. The base 12 has a cylindrical recess in which the lower large-diameter portion 14b and the spacer 13 are placed.

Although only four embodiments of this invention have been disclosed and described, it is apparent that other embodiments and modification of this invention are possible.

TABLE 1

Thermal Conductivity of Various High-Strength Materials

| Item | Thermal Conductivity (Kcal/m. hr. °C.) | at 400° C. |
|---|---|---|
| Steel | Low-carbon steel | 40 |
| | Non-corrosive steel | 15 |
| Ceramics | Sintered alumina (99.5%) | 8 |
| | Sintered alumina (80%) | 3.6 |
| | Sintered zirconia | 1.7 |
| | Sintered silicon carbide | 30 |
| | Sintered silicon nitride | 14 |
| Glass | Quartz glass | 1.3 |
| | Hard glass | 1.1 |
| | Soda lime glass | 0.7 |

TABLE 2

Through Heat Capacity of Thermal Insulating Materials

| Total Thickness | Compositions (Thickness) | Boundary Temperature °C. | Through Heat Capacity × $10^4$ Kcal/$m^2$ hr |
|---|---|---|---|
| 10 mm | 80% $Al_2O_3$ porcelain (8 mm) | 800 | 13.6 |
| | Soda lime glass (2 mm) | 595 | |
| | | 106 | |
| | 80% $Al_2O_3$ porcelain (6 mm) | 800 | 9.5 |
| | Soda lime glass (4 mm) | 656 | |
| | | 98 | |
| | Quartz glass (3 mm) | 800 | 6.6 |
| | Hard glass (3 mm) | 646 | |
| | Soda lime glass (4 mm) | 468 | |
| | | 90 | |
| 8 mm | 80% $Al_2O_3$ porcelain (5 mm) | 800 | 12.3 |
| | Soda lime glass (3 mm) | 680 | |
| | | 102 | |
| | Quartz glass (3 mm) | 800 | 8.9 |
| | Hard glass (3 mm) | 594 | |
| | Soda lime glass (2 mm) | 353 | |
| | | 97 | |
| 6 mm | Sintered zirconia (6 mm) | 800 | 16.6 |
| | | 108 | |
| | Sintered zirconia (4 mm) | 800 | 12.4 |
| | Soda lime glass (2 mm) | 456 | |
| | | 104 | |

What is claimed is:

1. A skid button for attachment to a skid pipe and for supporting steel thereon in a furnace, said skid button comprising:

a unitary ceramic button having a first cylindrical portion for supporting steel thereon and a second cylindrical portion of a diameter larger than that of said first cylindrical portion, said cylindrical portions being integrally formed as a single ceramic body;

attachment means, in the form of a cylindrical member, for attaching said ceramic button to a skid pipe, said cylindrical member having a bottom and a top opening, said second cylindrical portion being contained within said attachment means and spaced inwardly from the bottom of said attachment means to define a gap therebetween; and thermal insulating material disposed in said gap.

2. The skid button of claim 1 in which a ceramic plate is disposed in said gap between the thermal insulating material and the bottom portion of the ceramic button.

3. The skid button of claim 1 in which the thermal insulating material has high strength, high density, low thermal conductivity and a high coefficient of thermal expansion.

4. The skid button of claim 1 in which the thermal insulating material is selected from the group consisting of quartz glass, VYCOR glass, hard glass and soda lime glass.

5. The skid button of claim 1 in which the thermal insulating material is made of mullite porcelain containing 30–80% by weight of $Al_2O_3$ and sintered zirconia.

6. The skid button of claim 1 in which the thermal insulating material is made of a non-crystalline glass.

7. The skid button of claim 1 wherein said ceramic button has a tapered waist portion connecting said first and second cylindrical portions and wherein said top opening is of a diameter less than the diameter of said second cylindrical portion and is defined by a tapered circumferential surface for mating with the tapered waist portion of the ceramic button so as to hold said ceramic button in a predetermined position.

8. The skid button of claim 1 wherein said cylindrical member includes an upper ring-shaped portion and a lower plate-shaped portion fixed thereto by welding.

9. The skid button of claim 1 in which said waist portion of said ceramic button is formed in a convex tapered shape and the tapered circumferential surface is formed in a mating, concave shape.

10. The skid button of claim 1 in which said waist portion of said ceramic button is formed as a portion of a spherical surface.

11. A skid button for attachment to a skid pipe and for supporting steel thereon in a furnace, said skid button comprising:

a ceramic button having a first cylindrical portion for supporting steel thereon, a second cylindrical portion of a diameter larger than that of said first cylindrical portion and a waist portion connecting said first and second cylindrical portions, said first and second cylindrical portions and said waist portion being integrally formed as a single ceramic body;

attachment means, in the form of a cylindrical member, for attaching said ceramic button to a skid pipe, said attachment means having a bottom and a top opening, said second cylindrical portion being contained within said attachment means and spaced inwardly from the bottom of said attachment means to define a gap therebetween; and a glass plate disk disposed within said gap.

12. The skid button of claim 11 wherein said waist portion of said ceramic button is formed with a taper and said top opening is defined by a tapered circumferential surface mating with said waist portion so as to hold the ceramic button in a predetermined position.

13. The skid button of claim 11 in which the taper of said waist portion is convex and the taper of said circumferential surface is concave.

14. The skid button of claim 13 in which said waist portion of said ceramic button is formed as a part of a spherical surface.

15. The structure of claim 11 in which the glass plate is quartz glass, VYCOR glass, hard glass or soda lime glass.

* * * * *